US005704528A

United States Patent [19]

Faure

[11] Patent Number: 5,704,528

[45] Date of Patent: Jan. 6, 1998

[54] MULTI-PURPOSE VALISE

[76] Inventor: Frances Wister Faure, 86, rue de Grenelle, F-75007 Paris, France

[21] Appl. No.: 725,826

[22] Filed: Oct. 7, 1996

[51] Int. Cl.[6] ..... A45F 3/04

[52] U.S. Cl. ..... 224/583; 224/153; 224/655; 224/656; 383/2; 150/105; 190/103; 190/110

[58] Field of Search ..... 224/575, 576, 224/577, 153, 581, 582, 583, 627, 645, 654–659; 383/2, 7; 150/105, 112, 113, 118, 119; 190/103, 104, 105, 109, 110, 111

[56] References Cited

U.S. PATENT DOCUMENTS

| | | | |
|---|---|---|---|
| 1,553,697 | 9/1925 | Lederer | 383/2 |
| 3,061,057 | 10/1962 | Miller | 190/110 |
| 3,229,741 | 1/1966 | Ambrose | 383/2 |
| 3,347,299 | 10/1967 | Alexander | 150/113 |
| 4,018,369 | 4/1977 | Jaeger | 224/582 |
| 4,117,874 | 10/1978 | Berenguer | 383/2 |
| 4,386,642 | 6/1983 | Durbin | 190/110 |
| 4,756,394 | 7/1988 | Cohen | 383/2 |
| 4,883,207 | 11/1989 | McArthur | 224/153 |
| 4,961,522 | 10/1990 | Weber | 224/153 |
| 5,472,279 | 12/1995 | Lin | 383/2 |

FOREIGN PATENT DOCUMENTS

| | | | |
|---|---|---|---|
| 167038 | 4/1950 | Austria | 224/209 |
| 1010467 | 6/1952 | France | 224/209 |
| 1066709 | 6/1954 | France | 383/2 |
| 1076854 | 11/1954 | France | 383/2 |
| 2752944 | 12/1978 | Germany | 150/113 |
| 3600794 | 8/1986 | Germany | 190/110 |

*Primary Examiner*—Henry J. Recla
*Assistant Examiner*—Gregory M. Vidovich
*Attorney, Agent, or Firm*—Karl Hormann

[57] ABSTRACT

A multi-purpose valise functioning as a variable volume backpack and consisting of two selectively connectible components, one larger than the other, the large component serving at times to store the smaller component which is provided with a flap for closing the larger component, the volume of the larger component being compactable by reducing the axial length of the larger component.

12 Claims, 3 Drawing Sheets

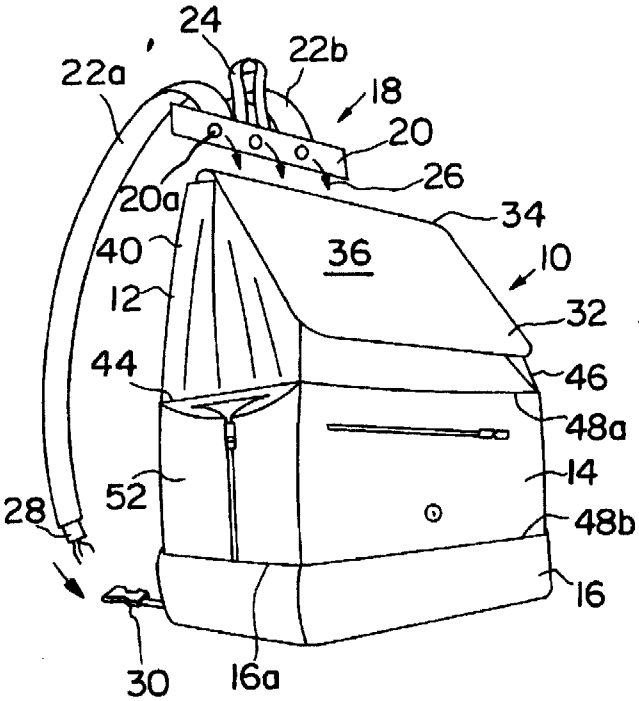
FIG. IA
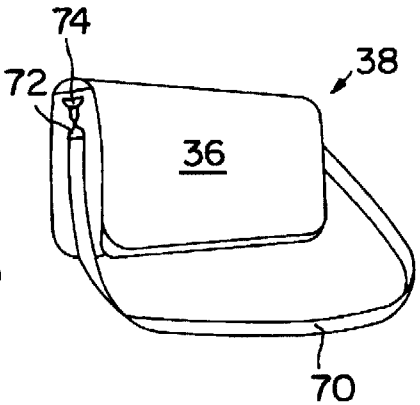
FIG. IB
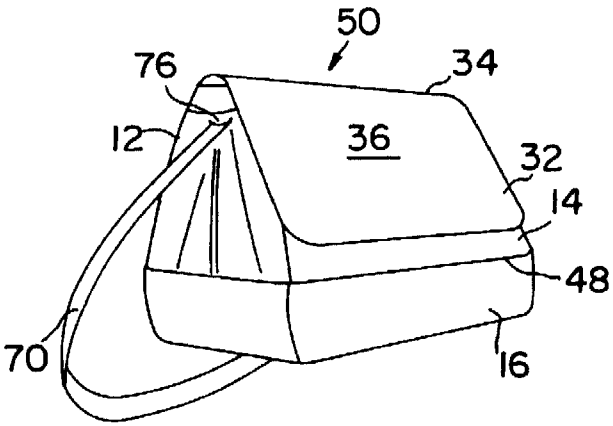
FIG. IC

MULTI-PURPOSE VALISE

BACKGROUND OF THE INVENTION

1. Field of the Invention

The invention, in general, relates to a multi-purpose valise and, more particularly, to a backpack which may easily be converted into hand bags of different sizes.

2. The Prior Art

Backpacks have been known substantially throughout recorded human history. They recommend themselves as simple, but effective and convenient means for carrying many kinds of goods. In their simplest form, they consist of a bag open at one end which may be closed by a draw string, and a harness of two shoulder straps respectively connected to a center portion adjacent to the open end and to opposite corners at the closed end of the bag. More advanced types of backpacks may additionally be provided with a carrying frame and external and/or internal pockets to augment the main compartment.

While in many respects they are practical, backpacks nevertheless are disadvantageous in that they cannot readily be adjusted or converted to accommodate the various needs or circumstances a modern traveler may encounter.

For instance, modern means of transportation such as airplanes, trains, omnibuses and even automobiles usually restrict the number of pieces of luggage a traveler may take with him into the cabin. Yet at the same time, the opportunity for multifarious activities in which a traveler may engage while on a journey is greater than ever before. Possible activities may vary from formal to informal ones, each requiring, or at least making it desirable, to have a suitable kind or size of bag without, however, increasing the total amount of luggage with which the traveler has to contend.

In airplane travel in particular, travelers are usually required to check large or heavy pieces of luggage for stowage in the freight compartment, and they are limited to one piece of luggage, such as a cabin bag, pocket book and wallet which may accompany them into the cabin.

A single piece of luggage easily adjustable or convertible to suit all the circumstances a traveler is likely to encounter during his journey would be a practical and desirable utensil.

OBJECTS OF THE INVENTION

Accordingly, it is an object of the invention to provide a valise useful for many different purposes and in many different circumstances.

A more particular object of the invention is to provide a backpack which is convertible into various configurations and sizes to accommodate many different functions.

Another object is to provide a modular backpack consisting of a plurality of functionally different components which may selectively and easily be assembled or separated for utilization specific to given circumstances.

Still another object of the invention resides in the provision of a backpack composed of a plurality of self-contained modules.

It is also an object of the invention to provide a piece of luggage made up of a plurality components which complement each other in a symbiotic manner.

Another object of the invention is to provide a modular backpack the individual components of which may easily be assembled into a compounded unit by appropriate matching color-codes.

Yet another object of the invention resides in the provision of a valise of the kind referred to in which at least one of the components may be varied in its volume.

Other objects will in part be obvious and will in part appear hereinafter.

BRIEF DESCRIPTION OF A PREFERRED EMBODIMENT

In the accomplishment of these and other objects, the invention, in a preferred embodiment thereof, provides for a valise comprising at least a first component and a second component each provided with one connector of a complement—any pair thereof for selective releasable connection to each other, at least one of the first and second components being provided with means for reducing its volume or capacity, and one of the first and second components being provided with closure means for closing the other component when the first and second components are connected to each other.

BRIEF DESCRIPTION OF THE SEVERAL DRAWINGS

The novel features which are considered to be characteristic of the invention are set forth with particularity in the appended claims. The invention itself, however, in respect of its steps, its sequence of operation as well as the arrangement and construction of the parts constituting its preferred physical embodiments, together with other advantages and objects thereof, will be best understood from the following description, when read in connection with the appended drawings, in which:

FIG. 1 is a perspective exploded view of a first embodiment of a backpack, pocketbook and shoulder harness in accordance with the invention, depicting the convertibility of the arrangement;

DETAILED DESCRIPTION OF THE PREFERRED EMBODIMENTS

Figure 3:
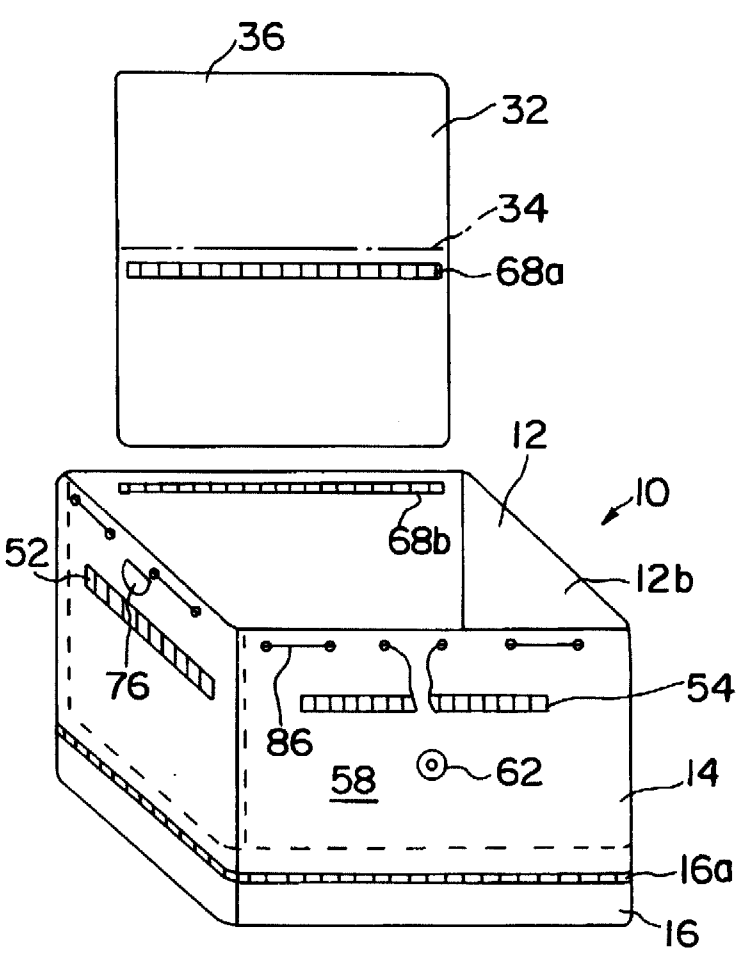
FIG. 3 is a perspective exploded front view of a the backpack of FIG. 2 in its compacted condition and a rear view of the pocket book removed therefrom.

With a view to simplifying the ensuing description, like reference characters will be used in the drawings for like parts of the various embodiments of the invention. Unless otherwise indicated, references hereinafter to zippers will be understood to include closures which while of substantially similar function may not be similar in appearance, such as, for example, Velcro® strips, belts and buckles, buttons and button holes or loops, as well as snap buttons and snap buckles. The materials from which the various components of the valise may be made are a matter of design and style and include, but are not limited to, leather and natural and synthetic fiber webs.

Figure 2:
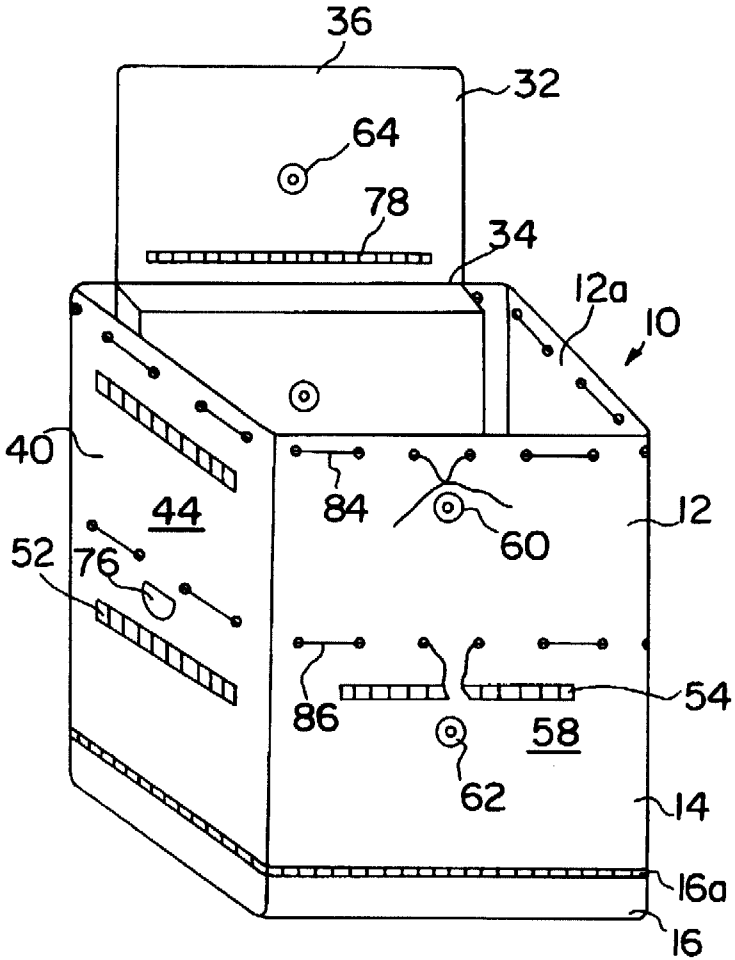
FIG. 2 is a perspective view of an alternative embodiment of the backpack and pocket book in their assembled open condition.

Turning now to FIGS. 1*a* and 2, there are shown first and second embodiments of a backpack 10 in accordance with the invention. While they are generally similar in their three-dimensional configuration, they differ, as will hereinafter appear, in the way in which they are manipulated. In FIG. 1*a*, the backpack 10 is shown in its closed condition with a substantially prismatically folded upper part 12 and a parallelepiped lower part 14 having a separable bottom section 16.

Figure 4:
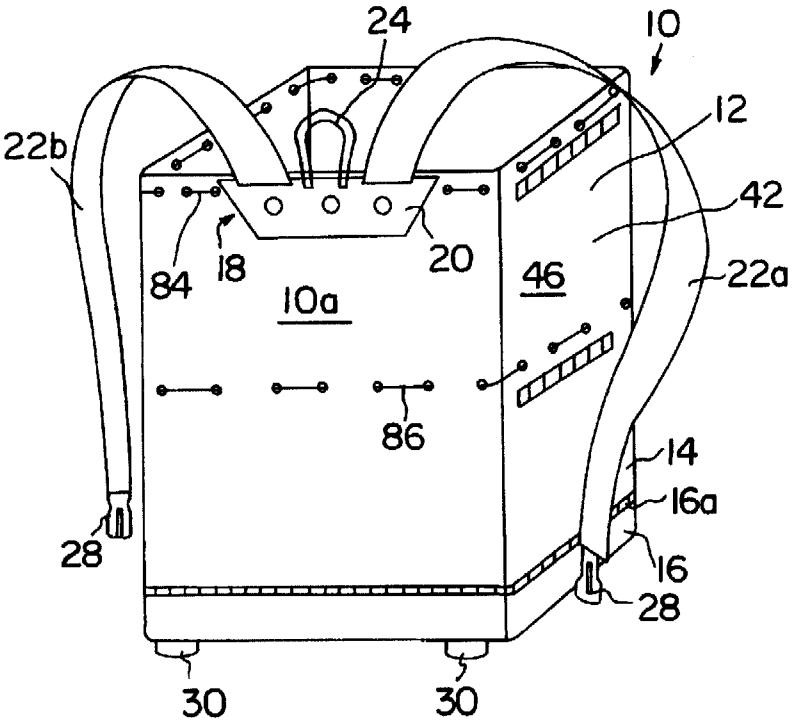
FIG. 4 is a perspective rear view of the backpack of FIG. 2 in its erected condition.

In FIG. 2, the backpack 10 is shown in it open erect condition with the upper part 12 unfolded to reveal a generally rectangular opening 12*a*. As shown in FIGS. 1*a*, 2 and 4, the lower part 14 may be provided with zippered pockets 52 and 54, and for purposes to be described, it is preferably made of a limp collapsible material. A shoulder harness 18 made of leather or in any case of strong material, including a connector bar 20, left and right shoulder straps 22*a* and 22*b* and a carrying loop or handle 24 may releasably be connected to a back panel 10*a* of the backpack 10 (see also FIG. 4). To this end, the connector bar 20 is provided with a plurality, here three, openings 20*a* which are adapted to be received, as schematically indicated by arrows 26, on pins or hooks (not shown) protruding from the pack panel 10*a*. Lower ends of the shoulder straps 22 are provided with snap buckles or carbine hooks 28 or the like for releasable connection with complementary catches or rings 30 at the lower back corners of the backpanel 10*a* at the bottom section 16.

In the embodiments herein disclosed, the bottom section 16 constitutes a separate compartment of the backpack 10, positioned below the lower part 14 thereof and may serve at times to store the harness 18 and other parts to be described, when they are not in use. The bottom section 16 may releasably be connected to the lower part 14 of the backpack 10 by a zipper 16*a*. The lower part 14 is provided with its own bottom panel. Preferably, the bottom section 16 is a completely enclosed pouch and is made of an especially sturdy material, such as leather, as it serves as the support for the backpack 10 in its fully assembled and sometimes heavily packed condition.

One of the rectangular surfaces 32 of the prismatically folded upper portion 12 is pivotable about a line 34 and at times functions as a closure flap 36 of the backpack 10 covering the opening 12*a* as well as the front portion of the upper part 12. The flap 36 is, however, an integral part of a pocket book 38 (FIG. 1*b*) and provides additional and readily accessible storage at all times.

The pocket book 38 may be selectively connected to the backpack 10 in a manner to be described. The triangular end surface portions 40 of the upper part 12 are in fact folded upper portions of side panels 44 and 46 of the backpack 10. They may be unfolded to a rectangular shape as shown in FIG. 2 when the backpack 10 is in its open condition for packing and/or for receiving the pocket book 38.

In the embodiment of the backpack 10 shown in FIG. 1*a*, a separable zipper 48 made up of two matching portions 48*a* and 48*b*, the latter being in contact with the zipper 16*a*, is connected to, and surrounding the backpack 10 in parallel relationship at the bottom of its upper part 12 and at the bottom of its lower part 14 adjacent the top of the bottom section 16. Preferably, the zipper portions 48*a* and 48*b* are both covered by a lip (not shown) to conceal and protect them. When separated, the zipper 48 releases, or permits extending, the parallelepiped lower portion 14 to increase the volume of the backpack 10 as shown in FIG. 1*a*. On the other hand, when the two portions 48*a* and 48*b* of the zipper 48 are connected to each other, the lower part 14 will be collapsed inside the backpack 10 which thus assumes a compacted configuration as shown at 50 in FIG. 1*c*, in which it may serve as a handbag, for instance. Further compaction may be obtained by removal of the bottom section 16. In the compacted configuration 50 the backpack 10 is of reduced bulkiness and may serve as a shopping bag, for instance.

In an alternative embodiment, instead of being matching portions 48*a* and 48*b* of a single zipper 48, each portion may be a complete zipper to allow complete removal of the lower part 14 and connection of the bottom section 16 to the upper part 12 of the backpack 10. For concealment and protection, each zipper is preferably covered by a lip of a suitable material (not shown).

In the embodiment shown in FIGS. 2, 3 and 4, the upper part 12 is adapted to fold into the lower part 14 of the backpack 10 substantially along a line occupied by the zipper portion 48*a* of the previously described embodiment. In the second embodiment, the upper and lower parts of the front panel 58 of the backpack 10 are each provided a snap button or catch 60 and 62 adapted to mate, depending upon whether the backpack 10 is in its expanded or compacted condition, with a matching snap button or catch 64 on the closure flap 36.

As may be seen in FIG. 2 and 3, the pocket book 38 may be connected to the inside of the backpack 10, at an upper portion of the backpanel 10*a* thereof. To this end, the back of the pocket book 38 and the inside upper portion of the backpanel 10*a* of the backpack 10 are provided with matching separable zipper portions 68*a* and 68*b*. The zipper portion 68*a* on the back of the pocket book 38 is preferably covered by a decorative lip to protect the zipper when the pocket book 38 is in use separate from the backpack 10. Another zipper portion 68*b*' is provided along the lower margin of the upper part 12 on the outside thereof, somewhat above the fold line (see FIG. 3) to permit attaching the pocket book 38 when the upper part 12 is folded into the lower part 14, the zipper portion 68*b*' being then positioned inside the backpack 10. When in its collapsed condition, the backpack 10 may be carried by a shoulder strap 70 of the pocket book 38. For this purpose, the shoulder strap 70 is provided with carbine hooks 72 which may be fastened to rings 74 provided on the side surfaces of the pocket book 38 and to rings 76 on the side panels 44 and 46 on the lower part 14 of the backpack 10. When not in use, the shoulder strap 70 may be removed and stored in the bottom section 16, for instance.

Figure 5:
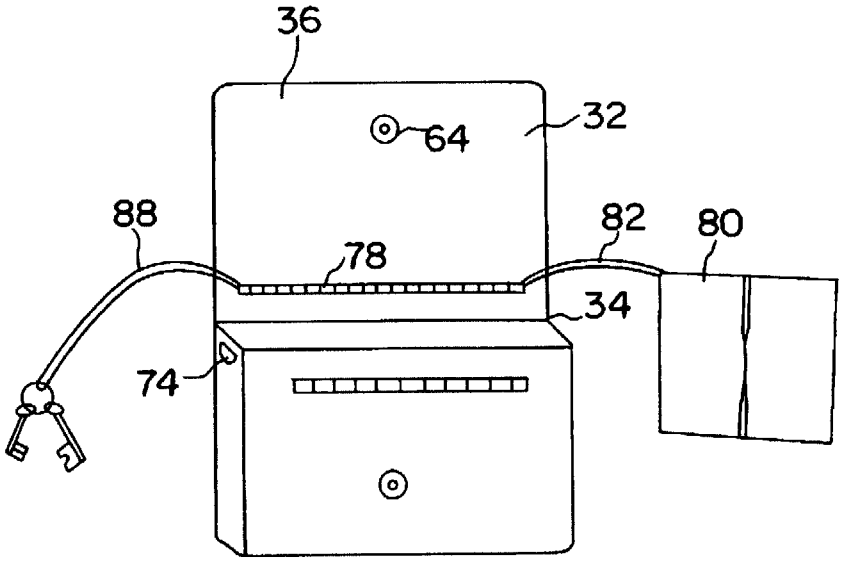
FIG. 5 is a front view in perspective of the pocket book of FIG. 2 showing components connected thereto.

The inside of the flap 36, i.e. the side facing the pocket book 38, is preferably provided with a pocket closable by a zipper 78. As shown in FIG. 5, the pocket may serve to store a wallet 80 connected thereto by a belt or chain 82 or the like. Additional belts or chains 88 may be provided to secure keys and other small utensils. In this manner, all items stored in the pocket of the flap 36 will be accessible at all times even when the pocket book 38 is mounted in the backpack 10, as its flap 36 serves as a closure flap for the backpack 10 as mentioned above.

When the pocket book 38 is removed from the backpack 10, the latter may be closed by a draw string 84 surrounding the upper part 12 or, when the backpack 10 is in its collapsed state, by a draw string 86 circumscribing the lower part 14.

The invention offering the advantages and features herein set forth provides for a versatile valise which is believed to accommodate most of the requirements a traveler may have in terms of luggage.

What is claimed is:

1. A modular valise, comprising:

a first module comprising a plurality of first web means to form a first three-dimensional body portion having internal and external surfaces enclosing a first interior volume and defining a first opening;

first connector means provided on the external surface of one of the first web means;

means comprising an extension of the one first web means and connected thereto adjacent to said opening for folding over the opening about a predetermined line;

a second module of variable volume greater than the first volume and comprising a plurality of second web means to form a second three-dimensional body portion having external and internal surfaces enclosing a second interior volume greater than the first volume and defining a second opening;

second connector means provided on an internal surface of one of the second web means adjacent the second opening adapted to releasably connect with the first connector means with the extension protruding out of the second opening to be folded about the predetermined line over the second opening, and means for relasably connecting said extension to an exterior surface of another of said second web means when said extension is folded over said second opening.

2. The valise of claim 1, wherein the second three-dimensional body portion is of a predetermined dimension extending along a predetermined axis and is further provided with means for reducing the predetermined dimension.

3. The valise of claim 2, wherein the dimension reducing means comprises axially spaced fastening means mounted on the external surfaces of the second web means wherein said fastening means are adapted to be connected to each other for reducing the volume of said second module.

4. The valise of claim 3, wherein the fastening means comprises first and second portions of a zipper surrounding the second three-dimensional body portion in spaced-apart parallel relationship and adapted to be connected to each other.

5. The valise of claim 2, wherein the second three dimensional body portion comprises a plurality of axially aligned sections connected to each other by separable and selectively connectible fastening means.

6. The valise of claim 5, wherein the separable and selectively connectible fastening means comprises zipper means arranged in substantially parallel spaced-apart relationship.

7. The valise of claim 2, wherein the predetermined dimension is reducible by folding a predetermined length of the second web means of the second three-dimensional body into the body.

8. The valise of claim 7, wherein additional second connector means is provided on an exterior surface of the second web means and is adapted to be positioned inside the body when the predetermined length of the second web means is folded into the body.

9. The valise of claim 1, wherein the extension comprises a double layer of the first web means to provide a pocket therein.

10. The valise of claim 9, wherein the pocket is provided with a closable opening.

11. The valise of claim 1, wherein the second body portion is provided with releasable shoulder harness means.

12. The valise of claim 1, wherein the second body portion is provided with a separable section at its end opposite the second opening.

* * * * *